US005988389A

United States Patent [19]

Buscema

[11] Patent Number: 5,988,389

[45] Date of Patent: Nov. 23, 1999

[54] ARTICLE CRADLE

[75] Inventor: Craig W. Buscema, Atlanta, Ga.

[73] Assignee: The Mead Corporation, Dayton, Ohio

[21] Appl. No.: 09/030,628

[22] Filed: Feb. 25, 1998

[51] Int. Cl.[6] ..... B65D 81/02

[52] U.S. Cl. ..... 206/594; 229/120.37; 229/164.2

[58] Field of Search ..... 206/583, 521, 206/594, 592, 591, 585; 220/528; 229/120.37, 161, 164.2, 104

[56] References Cited

U.S. PATENT DOCUMENTS

| | | | |
|---|---|---|---|
| 2,888,186 | 5/1959 | Meyers . | |
| 2,901,156 | 8/1959 | Vines | 229/120.37 |
| 2,909,311 | 10/1959 | Levitt . | |
| 2,924,370 | 2/1960 | Lemon . | |
| 3,352,473 | 11/1967 | Graser . | |
| 4,117,929 | 10/1978 | VanderMey | 206/326 |
| 4,143,804 | 3/1979 | Visvydas . | |
| 4,148,428 | 4/1979 | Gardner . | |
| 4,171,745 | 10/1979 | Zicko . | |
| 4,211,359 | 7/1980 | Chaffin . | |
| 4,219,148 | 8/1980 | Garmon . | |
| 4,249,691 | 2/1981 | Gardner . | |
| 4,251,020 | 2/1981 | Schwaner . | |
| 4,280,650 | 7/1981 | Gardner et al. . | |
| 4,294,398 | 10/1981 | Chidsey, Jr. . | |
| 4,320,839 | 3/1982 | Skaggs | 206/591 |
| 4,330,078 | 5/1982 | Graser . | |
| 4,333,600 | 6/1982 | Gardner . | |
| 4,335,830 | 6/1982 | Garganese | 220/462 |
| 4,417,684 | 11/1983 | Skaggs . | |
| 4,583,677 | 4/1986 | Neese et al. . | |
| 4,613,045 | 9/1986 | Watson | 206/512 |
| 4,793,547 | 12/1988 | Lapoule et al. . | |
| 4,871,111 | 10/1989 | Mode | 229/104 |

*Primary Examiner*—Paul T. Sewell
*Assistant Examiner*—Nuan T. Lam
*Attorney, Agent, or Firm*—Michael V. Drew

[57] ABSTRACT

An article cradle (20) formed from a one-piece blank (10) has a bottom wall (22) and adjoining end (24) and side (40) walls. The end walls (24) have end wall flanges (26) extending therefrom. The side walls (40) have side wall flanges (46) extending therefrom. The end wall flanges are elongated and extend above (29) and below (28) the respective top and bottom edges of the end walls (24). The side wall flanges (46) are slightly elongated extending above (49) the top edges (48) of the side walls (40). The end walls and end wall flanges interlock with the side walls and side wall flanges to form an article compartment inwardly spaced from the outermost edges of the flanges.

22 Claims, 2 Drawing Sheets

ARTICLE CRADLE

The invention relates generally to packaging for articles, and more particularly to article cradles for isolating articles in a compartment which is inwardly spaced from the frame members supporting the cradle.

U.S. Pat. No. 4,171,745 discloses a protective insert for use with an outer package. It can be appreciated that it would be useful to have a means for isolating an article as fully as possible, and, further, to have such a means which can be formed from a one-piece blank, and, further still, to have such a means which can be combined with outer packaging to form a coordinated packaging system.

SUMMARY OF THE INVENTION

In accordance with a preferred embodiment of the invention an article cradle is formed from a one-piece blank. The cradle has a bottom wall and adjoining end and side walls. The end walls have end wall flanges extending therefrom. Similarly, the side walls have side wall flanges extending therefrom. The end wall flanges are elongated and extend above and below the respective top and bottom edges of the end walls. The side wall flanges are slightly elongated extending above the top edges of the side walls. The end walls and end wall flanges interlock with the side walls and side wall flanges to form an article compartment inwardly spaced from the outermost edges of the flanges.

Other advantages and objects of the present invention will be apparent from the following description, the accompanying drawings, and the appended claims.

DETAILED DESCRIPTION OF THE PREFERRED EMBODIMENT

Figure 1:
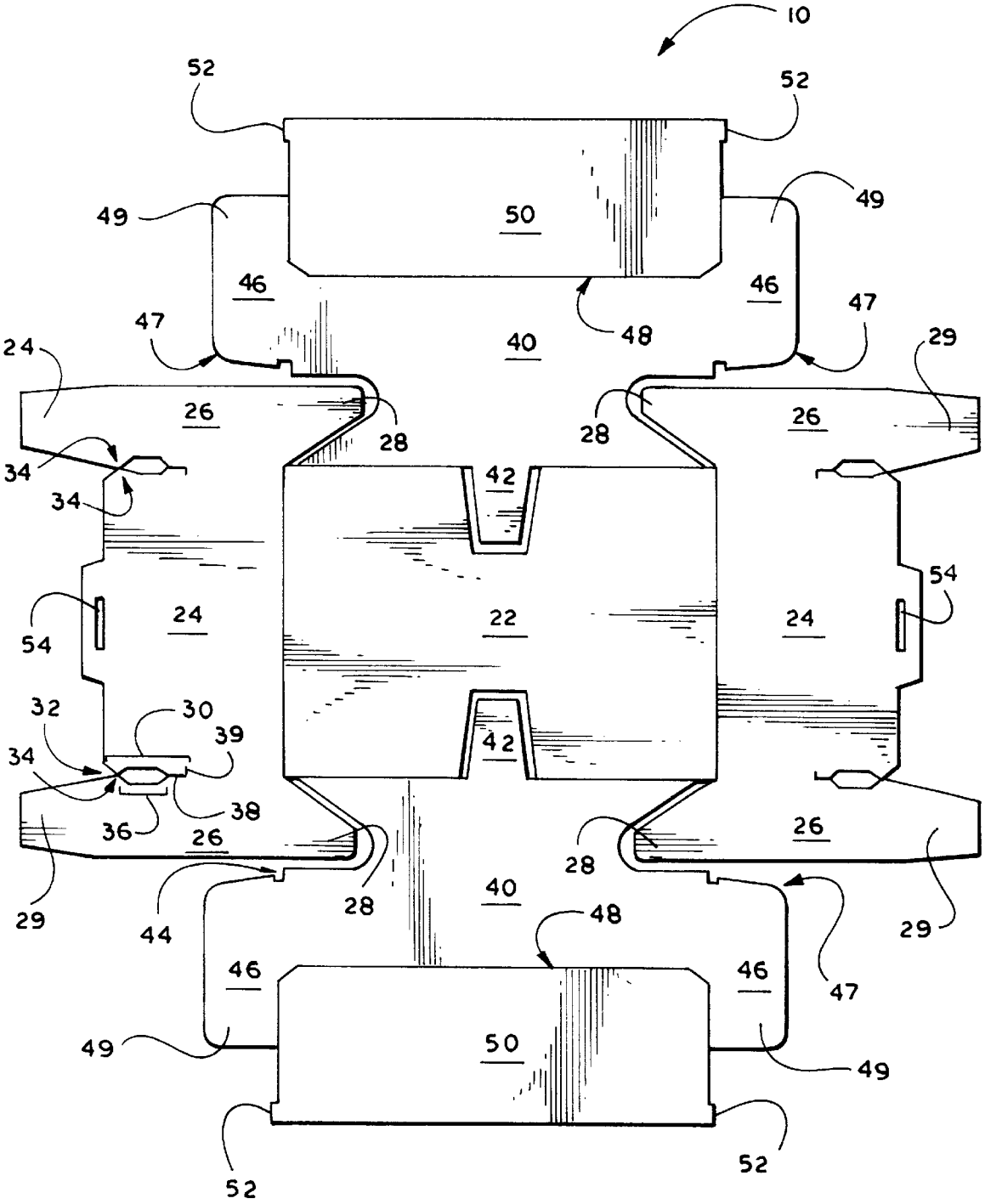
FIG. 1 is a plan view of an article cradle according to a preferred embodiment of the invention.

Throughout the drawings the same reference numerals are used to denote the same features.

Figure 2:
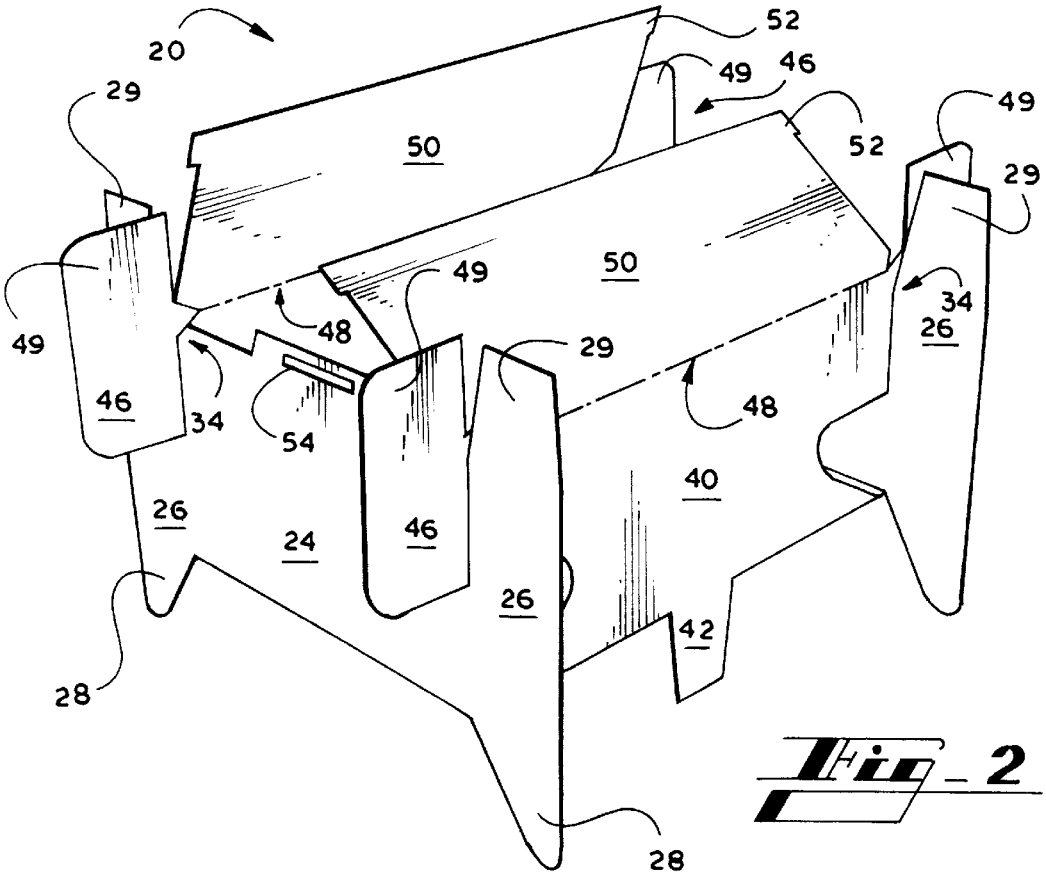
FIG. 2 is an isometric illustration of the erected cradle of FIG. 1.

Referring first to FIGS. 1 and 2, therein are respectively shown a blank 10 for forming an article cradle in accordance with a preferred embodiment of the invention and an erected article cradle 20 formed form the blank 10.

A bottom wall 22 has end walls 24 and side walls 40 foldably adjoined to the bottom wall 22. It is to be noted that the designation of walls as "end" and "side" walls is only for convenience in describing the features of the invention. For example, the walls could also be designated as "front and rear" or "left and right." The end walls 24 have end wall flanges 26 extending from either side edge. The end wall flanges 26 are elongated and have portions which extend above 29 and below 28 the respective top and bottom edges of the end walls 24. It is to be noted that in the two-dimensional blank 10 of FIG. 1 the orientation of top and bottom edges of the end walls 24 is more appropriately described as outermost and innermost edges. The side walls 40 have side wall flanges 46 extending from either side edge. The side wall flanges are slightly elongated having a portion extending above 49 the top edge 48 of the side wall 40. In the blank 10, the top edge of the side walls may be more appropriately described as the outermost edge 48.

The slot 30 includes a narrow opening 32 defined between opposing protrusions (which for convenience of reference may be referred to as nodes) 34. Following the nodes 34 is an elongated gap 36 which is wider than the spacing between the nodes 34. Following the gap 36 is an extremely narrow slit 38 which terminates in a cut line 39 which extends transversely from the slit 38. Because of the narrowness of the slit 38, it may in essence also be considered a cut line. To erect the cradle 20 of the preferred embodiment illustrated first the side walls 40 are placed in substantially perpendicular relation to the bottom wall 22. The end walls 24 are then pivoted upward into orthogonal relationship with the bottom wall 22 and the side walls 40. The positioning of the blank 10 and cradle 20 elements causes the gap 26 to receive the lower outside edge 47 of the side wall flanges 46. As the end wall 24 is pivoted into substantially perpendicular position the edge 47 of the flange 46 is guided by the gap 36 thereby causing the side wall flange 46 to become fully seated in the slot 30. It is noted that the ends of the gap portion 36 are tapered inwardly toward the respective node 34 portion and slit 38 portion. This tapering promotes movement of the side wall flanges 46 through the node 34 portion and slit 38 portion. In general, the nodes 34 and the slit 38 define openings which are just wide enough to accommodate the thickness of sheet material being used to form the cradle 20. In addition, if material is used which is slightly compressible an even more snug, secure interlocking arrangement is achieved. The transverse cut line 39 helps inhibit undesirable tearing of the end walls 24 and helps make the slit 38 more yielding to receipt of the side wall flange 46.

The lower edge of each side wall 40 extends below the side wall flange 46 a sufficient distance to provide an abutment against which the inner surface of the end wall 24 and end wall flange 26 is stopped. A seating notch 44 is formed at the intersection of the abutment and the side wall flange 46 to help secure the union of the side and end walls and their respective flanges.

It is to be noted that the preferred embodiment of the invention contemplates erection of the cradle 20 through use of a mandrel. For example, a first resistance surface of the mandrel receives the bottom wall 22. Actuators then pivot the side walls 40 into substantially perpendicular relationship with the bottom wall 20. Finally, actuators carry out the remaining step as described above of pivoting the end walls 24 and end wall flanges 26 into substantially orthogonal interlocking relationship with the side walls 40. A suitable mandrel for use with the preferred embodiment of the invention may be obtained through the Containerboard division of the Mead Corporation located in Atlanta and Covington, Ga., and is also believed to be obtainable from the Otor Corporation located in western Europe.

In the preferred embodiment a top wall is formed from at least one top wall panel 50. The top wall panels are pivoted with respect to the side walls 40 to form a top closure cover for the compartment. A mechanism for locking the top wall panels 50 in place over the compartment consists of locking tabs 52 formed on edges of the top wall panels 50 and cooperating locking slots 54 formed in the end walls 24 for receiving and engaging the locking tabs 52. Two top wall panels 50 are shown foldably adjoining the top edge (or outermost edge) 48 of the side walls 40. However, it is to be noted that placement of the top wall features may be reversed without consequence.

The preferred embodiment illustrated also includes additional supporting structure in the form of leg members 42 extending from the side walls 40. It is to be noted that additional or substitute leg members 42 may also be associated with the end walls 24.

Figure 3:
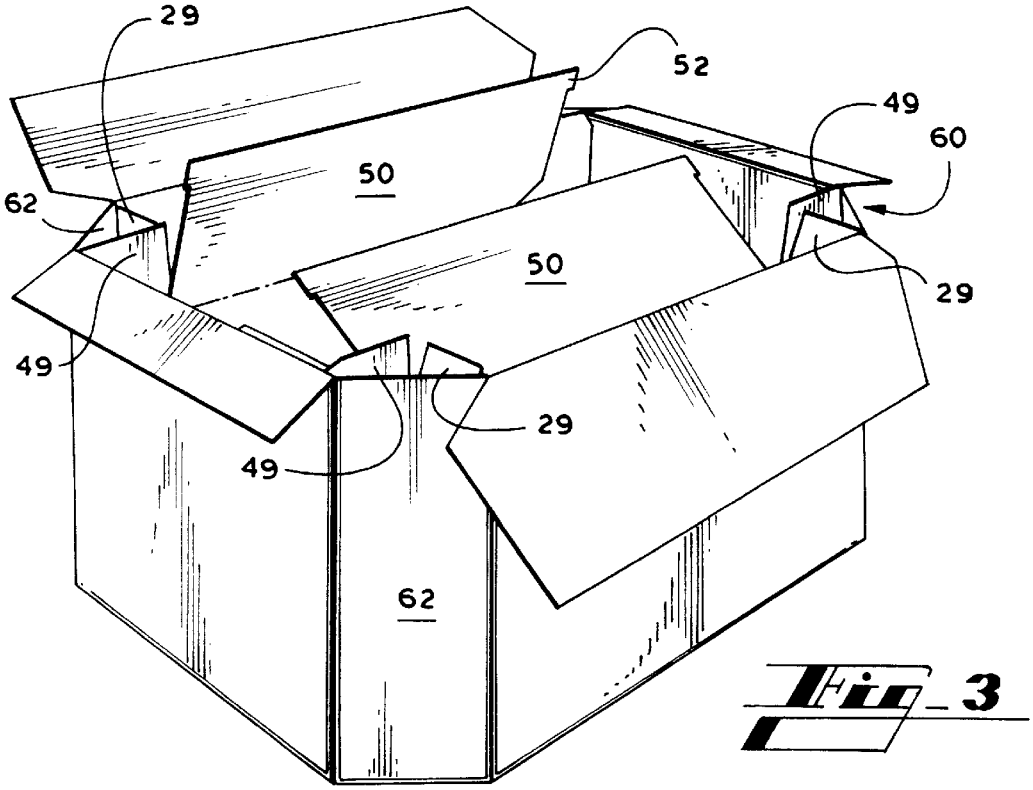
FIG. 3 is an isometric illustration of the cradle of FIG. 2 shown in conjunction with a carton to form a coordinated packaging system.

The invention forms an article compartment which is able to isolate an enclosed article from undesirable contact while the article is transported or stored. It is to be noted that the cradle 20 may be used alone as stand-alone protective packaging. However, the cradle 20 is particularly suitable for use with cartons such as the octagonal carton 60 shown in FIG. 3 to form a coordinated packaging system. The junctures of end wall flanges and side wall flanges are particularly useful for positioning in the beveled corners 62 of the octagonal carton. When the cradle 20 is used with the carton 60, isolation and protection of the compartment is not only provided by the flanges 26, 46 which form the frame structure of the cradle 20 but protection is also provided by the air space between all of the walls (bottom 22, end 24, side 40, top 50) of the cradle 20 and all of the walls (bottom, top, end, side, bevelled) of the carton 60. In addition, this air space may be filled with packing material such as foamed plastic or popcorn.

The cradle 20 is economical because it is formed from a single sheet but also obtains maximum isolation and support from all of its components. Using cut-outs to form the legs 42 (from the bottom wall) and lower portions 28 of the end wall flanges 26 (from the side walls) helps achieve minimum material usage. The material which is removed to form these elements 28, 42 does not appear to detract from the integrity of the walls from which the material is taken.

Modifications may be made in the foregoing without departing from the scope and spirit of the claimed invention. For example, in the preferred embodiment illustrated the end wall flanges 26 extend above 29 and below 28 the respective top and bottom edges of the end walls 24, however, it is possible to use only the bottom extensions 28 of the end wall flanges 26 while relying on the upper extensions 49 of the side wall flanges 46 to provide the protection desired above the top of the compartment. Similarly, the top portions 49 of the side wall flanges 46 might be omitted in favor of reliance upon only the top portions 29 of the end wall flanges 26. Use of all flange extensions 28, 29, 49 and leg members 42 provides optimum protection and isolation.

What is claimed is:

1. An article cradle formed from a blank comprising:

a bottom wall;

a pair of opposing side walls adjoining said bottom wall each said side wall having side wall flanges extending from respective distal side edges thereof; and a pair of opposing end walls adjoining said bottom wall each said end wall having end wall flanges extending from respective distal side edges thereof said end wall flanges having a portion extending below a bottom first edge of said end wall;

wherein a portion of at least one of said side wall flanges and said end wall flanges extends above a respective top second edge of said side wall and a top third edge of said end wall, and wherein said side walls and said end walls are interlocked with one another proximate said side wall flanges and said end wall flanges to form a compartment with said bottom wall such that said compartment is spaced inwardly of distal edges of said side wall flanges and said end wall flanges.

2. The article cradle of claim 1, further comprising a leg member extending from a fourth adjoining edge of at least one of said side walls and said end walls where said side wall or said end wall adjoins said bottom wall wherein said compartment is spaced inwardly of distal edges of said leg member.

3. The article cradle of claim 2, wherein said leg member is cut out from said bottom wall.

4. The article cradle of claim 1, wherein a slot is formed at a joinder of each of said end walls and said end wall flanges for receiving said side wall flanges and wherein said slot includes an opening having closely spaced apart protrusions, an elongated gap portion spaced further apart than said protrusions adjacent said opening and a slit narrower than said elongated portion.

5. The article cradle of claim 4, wherein said compartment is formable upon and said side walls and said end walls are interlockable by means of a mandrel.

6. The article cradle of claim 4, wherein said slit terminates at a cut line extending substantially transversely from said slit.

7. The article cradle of claim 1, wherein said portion of said side wall flanges extends above said top second edge of said side wall and said portion of said end wall flanges extends above said top third edge of said end walls.

8. The article cradle of claim 1, further comprising a top wall including at least one top wall panel adjoining at least one of said side walls and said end walls for covering a top opening of said compartment.

9. The article cradle of claim 8, further comprising a lock for locking said top wall in a position covering said top opening of said compartment.

10. The article cradle of claim 9, said lock comprising at least one locking tab extending from said top wall and a locking slot in at least one of said side walls and said end walls for receiving and engaging said at least one locking tab.

11. The article cradle of claim 1, wherein said portion of said end wall flanges which extends below said bottom first edge of said end wall is cut out from said side walls.

12. A packaging system comprising:

a cradle including a bottom wall;

a pair of opposing side walls adjoining said bottom wall each said side wall having side wall flanges extending from respective distal edges thereof; and a pair of opposing end walls adjoining said bottom wall each said end wall having end wall flanges extending from respective distal side edges thereof said end wall flanges having a portion extending below a bottom first edge of said end wall;

wherein a portion of at least one of said side wall flanges and said end wall flanges extends above a respective top second edge of said side wall and a top third edge of said end wall, and wherein said side walls and said end walls are interlocked with one another proximate said side wall flanges and said end wall flanges to form a compartment with said bottom wall such that said compartment is spaced inwardly of distal edges of said side wall flanges and said end wall flanges; and an octagonal carton having beveled corners, which said octagonal carton receives said cradle;

wherein pairs of said end wall flanges and said side wall flanges engage an inner surface of said octagonal carton proximate respective said beveled corners such that said cradle is substantially immobilized in said octagonal carton.

13. A blank for forming an article cradle comprising:

a bottom wall;

a pair of opposing side walls foldably adjoining said bottom wall each said side wall having side wall flanges extending from respective distal edges thereof; and a pair of opposing end walls foldably adjoining said bottom wall each said end wall having end wall flanges extending from respective distal edges thereof said end wall flanges extending inwardly of and beyond a joinder of said bottom wall and said end walls;

wherein at least one of said side wall flanges and said end wall flanges extends outwardly of and beyond an outermost edge of a respective said side wall and said end wall; and wherein when said side walls and said end walls are folded into substantially orthogonal relationship with respect to one another and with respect to said bottom wall, said side walls and said end walls may be interlocked with one another proximate said side wall flanges and said end wall flanges to form a compartment with said bottom wall such that said compartment is spaced inwardly of distal edges of said side wall flanges and said end wall flanges.

14. The blank of claim 13, further comprising a leg member cut out from said bottom wall extending from an edge of at least one of said side walls and said end walls where said side wall or said end wall adjoins said bottom wall inwardly and transversely of the respective said side wall or end wall wherein said compartment in the erected article cradle is spaced inwardly of distal edges of said leg member.

15. The blank of claim 13, wherein a slot is formed at a joinder of each of said end walls and said end wall flanges for receiving said side wall flanges when the article cradle is erected.

16. The blank of claim 15, wherein said slot includes an opening having closely spaced apart protrusions, an elongated gap portion spaced further apart than said protrusions adjacent said opening and a slit narrower than said elongated portion.

17. The blank of claim 16, wherein said slit terminates at a cut line extending substantially transversely from said slit.

18. The blank of claim 15, wherein said side wall flange is disposed such that an inner surface of said end wall abuts an end edge of said side wall when the cradle is erected.

19. The blank of claim 13, wherein said side wall flanges extend outwardly of outermost edges of respective said side walls and said end wall flanges extend outwardly of outermost edges of respective said end walls.

20. The blank of claim 13, further comprising a top wall including at least one top wall panel foldably adjoining at least one of said side walls and said end walls for covering a top opening of said compartment when the article cradle is erected.

21. The blank of claim 20, further comprising at least one locking tab extending from said top wall and a locking slot in at least one of said side walls and said end walls for receiving and engaging said at least one locking tab and thereby locking said top wall in a position covering said compartment when the article cradle is erected.

22. The article cradle of claim 13, wherein portions of said end wall flanges which extend inwardly of and beyond a joinder of said bottom wall and said end walls are cut out from said side walls.

* * * * *